US006531825B1

(12) United States Patent
Iacob

(10) Patent No.: US 6,531,825 B1
(45) Date of Patent: Mar. 11, 2003

(54) METHOD AND APPARATUS FOR SUPPLYING POWER FOR A VACUUM FLUORESCENT DISPLAY (VFD) FILAMENT

(75) Inventor: Alin Theodor Iacob, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/899,406

(22) Filed: Jul. 2, 2001

(51) Int. Cl.[7] ..... H05B 41/14

(52) U.S. Cl. ..... 315/105; 315/169.1; 315/169.4; 345/75.1

(58) Field of Search ..... 315/105, 97, 169.1, 315/106, 107, 94, 98, 209 R, 291, 307, 169.4; 345/75.1, 47; 330/113

(56) References Cited

U.S. PATENT DOCUMENTS 4,859,912 A * 8/1989 Lippmann et al. ..... 315/169.1
4,973,882 A * 11/1990 Waugh ..... 315/105
5,001,399 A * 3/1991 Layden ..... 315/105
5,402,042 A * 3/1995 Madsen ..... 315/105
5,442,259 A * 8/1995 Lameris et al. ..... 315/168
5,606,226 A 2/1997 Macks et al. ..... 315/169.4
5,925,982 A 7/1999 Liu ..... 315/105
5,952,788 A 9/1999 Graham et al. ..... 315/105
6,005,538 A 12/1999 Hoekstra ..... 345/47
6,205,821 B1 2/2000 Mart ..... 345/75

* cited by examiner

*Primary Examiner*—Hoanganh Le
*Assistant Examiner*—Ephrem Alemu
(74) *Attorney, Agent, or Firm*—Beyer Weaver & Thomas LLP

(57) ABSTRACT

A VFD driver circuit includes a DC power supply coupled to cascaded first power operational amplifier ($POA_1$) and second power operational amplifier ($POA_2$). The $POA_1$ is a self-oscillating power operational amplifier having a feedback circuit associated therewith whereas the $POA_2$ is configured in an essentially inverting unity gain mode. The $POA_1$ has a first $POA_1$ output node coupled to a first terminal of a VFD filament and a second $POA_1$ output node coupled to a first $POA_2$ input node. The $POA_2$ has a $POA_2$ output node coupled to a second terminal of the VFD filament. The shape of the output waveform delivered by the $POA_1$ is dependent upon the feedback circuit and can be any shape deemed suitable. Such shapes include a square wave, a sinusoidal wave, a triangular wave, a trapezoidal wave, clipped sinusoidal wave, and so on.

28 Claims, 6 Drawing Sheets

METHOD AND APPARATUS FOR SUPPLYING POWER FOR A VACUUM FLUORESCENT DISPLAY (VFD) FILAMENT

BACKGROUND OF THE INVENTION

1. Field of Invention

This invention relates generally to analog circuits, and more particularly supplying power for a vacuum fluorescent display (VFD) filament.

2. Description of Relevant Art

Vacuum fluorescent displays (VFDs) are a type of display that utilizes thermal emission of electrons from a cathode also referred to as a VFD filament (typically about 640° C.) and phosphor excitation at a target anode to generate a color display. In contrast to a CRT, for example, the electrons are accelerated by a much lower voltage and the pixels are switched on/off by changing the polarity of the electric potential at the target anode. For example, a positively charged target will attract electrons whereas a negatively charged target will repel them. In this way, attracted electrons excite the phosphors, which thereby emit light. It is one of the advantages of a VFD that the phosphors can be patterned in any shape making VFDs suitable for displaying, among other things, icons in consumer electronics. Due to their ruggedness and high luminance, VFDs are also employed in automobile dashboard and various headup type displays.

Typically, a VFD filament requires an AC power supply source in order to create a constant brightness across its entire length. Unfortunately, however, currently available AC power supplies are deficient in any number of ways requiring, for example, an AC power input or in some cases generating high electromagnetic interference (EMI) making them unsuitable for use in many consumer electronics as well as automobile displays. An another disadvantage of currently available AC power supplies is that they require expensive circuits to shut them off when the system is not in use.

Therefore, what is desired is a system and apparatus for supplying power to a VFD filament that provides a substantially uniform display, substantially free of EMI and also an inexpensive shutdown feature.

SUMMARY OF THE INVENTION

The invention is an electrical circuit that provides power to a VFD filament without resorting to using an AC power supply. In this way, the circuit substantially reduces the electromagnetic interference (EMI) generated by conventionally arranged VFD filament power supplies.

In one embodiment, an apparatus for supplying power to a vacuum fluorescent display (VFD) filament in a vacuum fluorescent display (VFD) unit having a display anode is described. The apparatus includes a DC power supply unit, a self-oscillating stage coupled to the DC power supply having a self-oscillating stage output node connected to a first terminal of the VFD filament, and an inverter stage coupled to the DC power supply having an inverter stage input node coupled to the self-oscillating stage output node and an inverter stage output node connected to a second terminal of the VFD filament. The self-oscillating stage provides a first output voltage waveform to the first terminal, and the inverter stage provides a second output voltage waveform to the second terminal such that the first output voltage waveform and the second output voltage waveform are anti-phase such that the VFD filament provides a substantially constant average voltage difference between the anode(s) and different points of the filament.

In another embodiment, a driver circuit for supplying power to a vacuum fluorescent display (VFD) filament in a vacuum fluorescent display (VFD) unit having a display anode is disclosed. The driver circuit includes a DC power supply unit, a first power operational amplifier coupled to the DC power supply having a first power operational amplifier output node connected to a first terminal of the VFD filament, and a second power operational amplifier coupled to the DC power supply having an second power operational amplifier input node coupled to the first power operational amplifier output node and a second power operational amplifier output node connected to a second terminal of the VFD filament. The first power operational amplifier provides a first output voltage waveform to the first terminal, and the second power operational amplifier provides a second output voltage waveform to the second terminal such that the first output voltage waveform and the second output voltage waveform are in anti-phase relation such that the VFD filament provides a substantially uniform voltage differential profile in relation to the display anode. The driver circuit also includes an external clock source coupled to the first power operational amplifier arranged to control a frequency of the first output waveform and the second output waveform, and a first shape of the first output waveform and a second shape of the second output waveform.

In still another embodiment, a method of providing power to a VFD filament is described. The method includes providing a DC power supply unit, coupling a self-oscillating stage coupled to the DC power supply having a self-oscillating stage output node, connecting the self-oscillating stage output node to a first terminal of the VFD filament, coupling an inverter stage to the DC power supply having an inverter stage input node, and coupling the inverter stage input node to the self-oscillating stage output node. The method further includes coupling an inverter stage output node to a second terminal of the VFD filament such that the self-oscillating stage provides a first output voltage waveform to the first terminal and the inverter stage provides a second output voltage waveform to the second terminal such that the first output voltage waveform and the second output voltage waveform are anti-phase such that the VFD filament provides a substantially uniform voltage differential profile in relation to the display anode.

These and other advantages of the present invention will become apparent to those skilled in the art upon a reading of the following descriptions of the invention and a study of the several figures of the drawing.

DETAILED DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Broadly speaking, a VFD driver circuit is described that can be integrated on the same integrated circuit with as is a grid/anode controller (also called micro-controller, computer or control logic) associated with a VFD tube. This level of integration is possible because the VFD driver circuit is supplied with the same standard voltage as is the controller (i.e. +5V). The circuit topology is also suitable for generating an approximation of a clipped sine wave while simultaneously driving a VFD filament. In addition, the described VFD driver circuit can be used to generate a drive signal of any shape heretofore unavailable with conventional VFD driver circuits.

Figure 1:
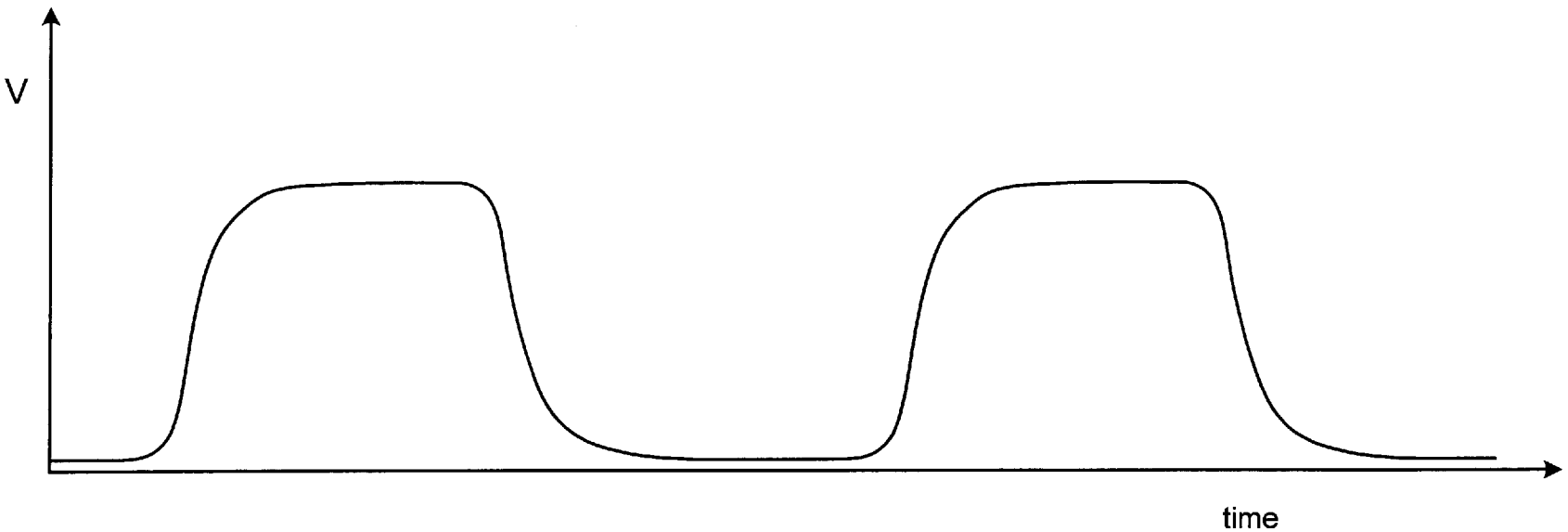
FIG. 1 shows a waveform generated by a VFD driver circuit in accordance with an embodiment of the invention.

By using a "Wien Oscillator" simplified by eliminating the amplitude control circuit and increasing the amplification factor "A" to approximately A=5.7 (where a typical Wien Oscillator needs an amplification factor of 3 in order to oscillate at stable amplitude and to generate a sinusoidal wave with a low distortion) the oscillator starts reliably and forces the VFD driver circuit to deliver a signal with a special shape shown in FIG. 1 that has lower high frequency components than a square-wave signal providing a very good compromise of EMI, power dissipation, circuit complexity and cost.

Figure 2:
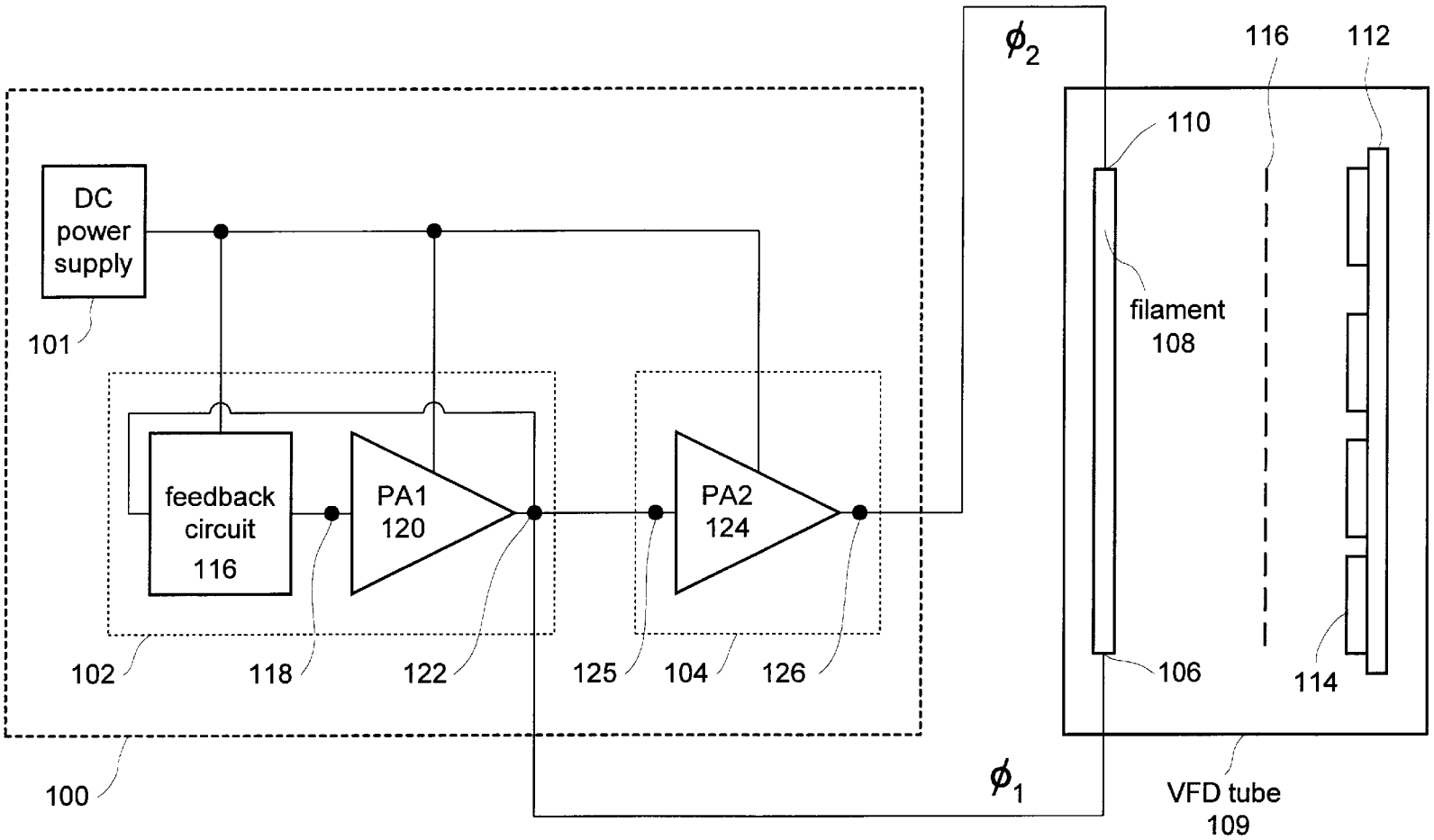
FIG. 2 is a block diagram of a VFD filament driver circuit in accordance with an embodiment of the invention.

A DC based method and apparatus for supplying power to a vacuum fluorescent display (VFD) filament is disclosed. Accordingly, FIG. 2 shows a VFD driver circuit 100 in accordance with an embodiment of the invention. The VFD driver circuit 100 includes a DC power supply 101 coupled to a self-oscillating stage 102 and an inverting stage 104 arranged to provide, respectively, a first voltage $Ø_1$ having a frequency $f_1$ to a first terminal 106 of a VFD filament 108 included in a VFD tube 109 substantially simultaneously with a second voltage $Ø_2$ having a frequency $f_2$ to a second terminal 110 of the VFD filament 108 connected thereto. Not shown in FIG. 2 but otherwise well known to those skilled in the art, are a front panel board having various input controls and a system board which is the source of the information displayed by the VFD tube 109.

In the described embodiment, the first voltage $Ø_1$ is in anti-phase relation to the second voltage $Ø_2$ (i.e., $Ø_2=/Ø_1$) where $f_1=f_2$ thereby substantially equalizing voltage differentials between the filament 108 (cathode) and a display anode 112. In this way, a substantially uniform emission of photons is generated by phosphors 114 on the display anode(s) 112 that pass through a grid 116 resulting in a uniform display with substantially no induced electromagnetic interference (EMI) by the DC power supply 101 (which in this case delivers +5V). It should be noted that with the described configuration, EMI is substantially reduced due, in part, to a reduced area loop (where the loop is formed of the VFD filament 108, its associated connections (106, 110) and the VFD driver circuit 100) being located very close to the VFD tube 109.

In one embodiment, the non-inverting stage 102 is formed of a feedback circuit 116 coupled to an input node 118 of a power amplifier ($PA_1$) 120 having an output 122 connected to the first terminal 106 of the VFD filament 108. The inverting stage 104 includes an inverting power amplifier ($PA_2$) 124 having an input node 125 connected to the output 122 of the $PA_1$ 120 and an output node 126 connected to the second terminal 110 of the VFD filament 108. In the described embodiment, the $PA_2$ 124 is configured as an inverting amplifier with amplifying factor of about 1.0 whereas the frequency and shape of output signals ($Ø_1$, $Ø_2$) are a function of the feedback circuit 116.

Figure 3:
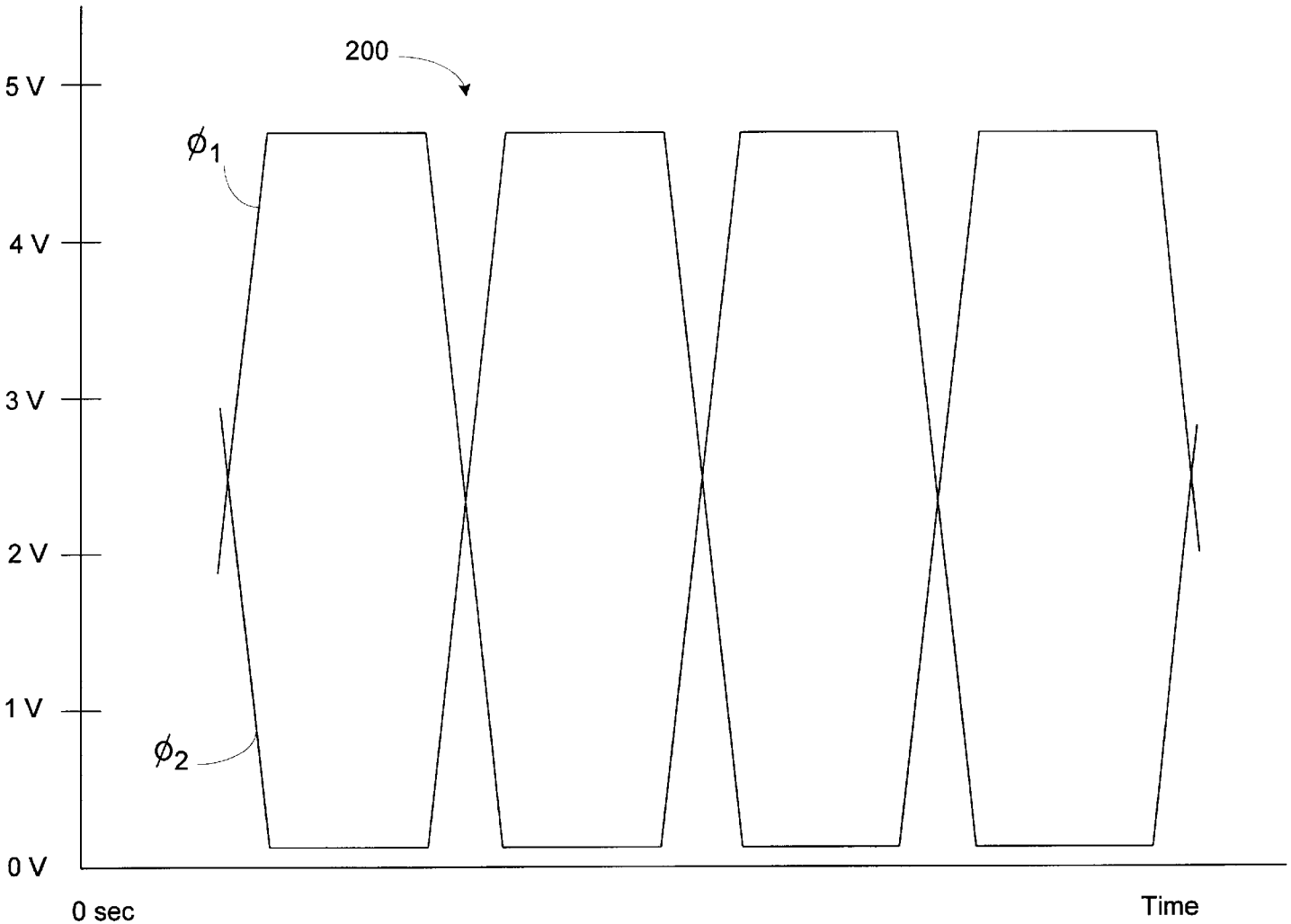
FIG. 3 shows an exemplary output waveform for output signals ($Ø_1$, $Ø_2$) in accordance with an embodiment of the invention.

FIG. 3 shows an exemplary output waveform 200 for output signals ($Ø_1$, $Ø_2$ ) that form a signal used to drive the VFD filament 108 in accordance with an embodiment of the invention. In the described embodiment, the shape of the signal used to drive the VFD filament 108 can be of any type: rectangular, trapezoidal, triangular, sinusoidal (all of them with equal or different rise and fall times) as well as a clipped sine wave suitable for reduced high frequency harmonics. Slow power operational amplifiers can also be used to reduce EMI.

By shaping the signal to have less time periods where the power amplifiers $PA_1$ and $PA_2$ are in a linear state, i.e., not fully off or not fully on, lower power dissipation (loss) in the driver circuit 100 is possible. Another power saving approach relies upon using a substantially rectangular shape signal. However, in order to compensate for an increase in EMI of from such a signal, a passive LC filter circuit (not shown) can be added between the power operational drivers $PA_1$ and $PA_2$ and the filament 108 where the passive LC filter causes no substantial power loss. Referring to FIG. 2, the LC filter can be connected between nodes 122, 126, 110, 106 and ground.

Figure 4:
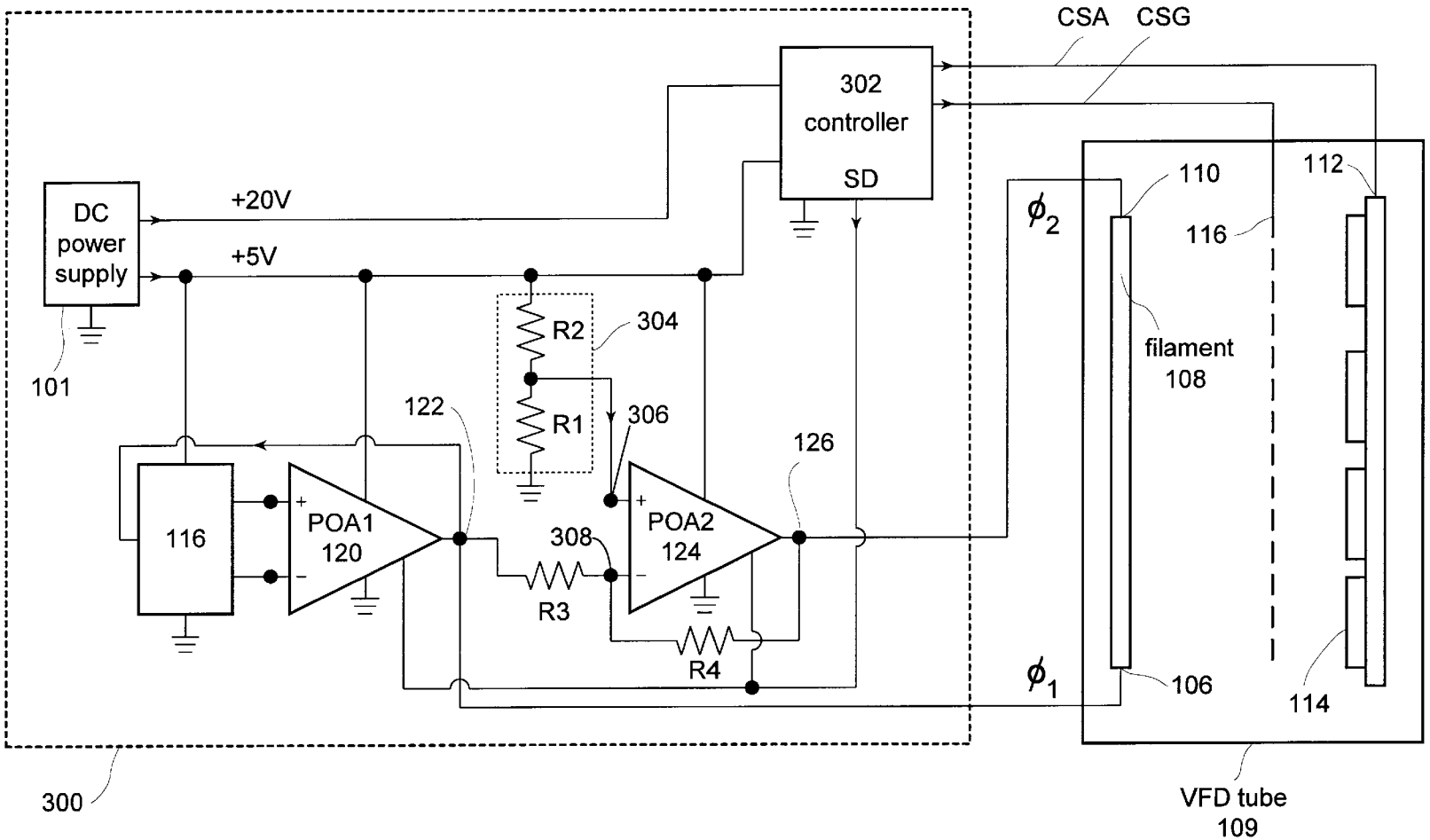
FIG. 4 illustrates a VFD filament driver circuit 300 in accordance with a particular embodiment of the invention.

FIG. 4 illustrates a VFD filament driver circuit 300 in accordance with a particular embodiment of the invention. It should be noted that the VFD filament driver circuit 300 is one embodiment of the VFD filament driver circuit 100 shown in FIG. 2 and described above in which the power amplifiers $PA_1$ 120 and $PA_2$ 124 are replaced, respectively, with power operational amplifiers $POA_1$ 120 and $POA_2$ 124 and should therefore not be considered limiting either the scope or intent of the invention. Accordingly, the VFD filament driver circuit 300 includes a controller 302 coupled to the DC power supply 101 arranged to provide a control signal for the anode (CSA) 112 and a control signal for the grid (CSG) 116 of the VFD tube 109, based upon particular icon(s) to be displayed. Although most applications will use multiple anodes and grids that will allow creating more complex icon patterns, FIG. 4 shows a simplified VFD tube 109 with one anode 112 and one grid 116 in order to not obscure the idea of this patent. Such icon based VFD tubes are typically found in many industrial and commercial uses that include weight measurement, lab equipment, monitoring systems as well as point of sale and vending machines. VFD tubes are also found in various consumer products such as DVD players, VCRs, set-top boxes, AV receivers, amplifiers, CD players, microwave ovens as well as standard ovens. It should be noted that short VFDs are less affected by the brightness variation because of the differential voltage across the filament, shorter filament will usually require lower voltage. Practically, for a short VFD that requires less than typically 2V supply, the brightness variation is not noticeable, and thus a DC power supply can be used instead of an AC. However for VFD tubes that have a length of more than 1–2 inches, an AC power supply is necessary in order to maintain a constant brightness across all the display area.

Since most systems employ VFD tubes with a length of more than 1–2 inches, this patent will add significant improvements for those applications. Additional uses include automobile displays found in many contemporary dashboards as well as car audio displays (i.e., radio/CD/tape/DVD display, etc). Since the VFD tube 109 is found in such close proximity to these EMI sensitive components, it is particularly advantageous that the VFD driver circuit 300 has substantially reduced EMI as compared to conventional VFD driver circuits.

It should be noted that in some embodiments of the invention, the two power operational amplifiers ($POA_1$ and $POA_2$) can be replaced by corresponding electronic switches. As well known in the art, electronic switches are a particular case of the operational amplifiers when they are driven to full swing, i.e. their output transistors are either off or at full-saturation.

Another approach to reducing EMI in the circuit 300 relies upon using a low cost filter in the form of a series LC that resonates at or close to the operating frequency. The filter can be added in series with the filament circuit. Since the filter is amortized by the resistance of the VFD filament, the filter's Q factor is low and therefore the values of the filter components do not have to be very accurate. Such a filter prevents high frequency components from passing through the VFD filament 108. Any other filter similar in principle with the above, having a two-pole or more -pole topology with the intention to reduce high frequency components can also be used.

In the described embodiment shown in FIG. 4, the VFD driver circuit 300 includes a voltage divider 304 that is formed of a resistor $R_1$ connected in serial with a resistor $R_2$ each of which is connected in parallel to a positive input node 306 of the $POA_2$ 124. It should be noted that resistors $R_1$ and $R_2$ are approximately equal to create a half voltage bias point for the positive input node 306 of $POA_2$ 124. It should be also noted that the approximate half voltage bias point can be created by other means including a voltage reference like a Zener or band-gap type. A resistor $R_3$ interconnects the output node 122 of $POA_1$ 120 to a negative input node 308 of the $POA_2$ 124. A resistor $R_4$ connected between the output node 126 and the negative input node 308 of $POA_2$ 124 provides appropriate negative feedback to $POA_2$ 124. In the described embodiment, resistor $R_3$ and resistor $R_4$ are approximately equal in resistive value in order to set the amplification factor of $POA_2$ 124 to approximately 1.0. In this way, the $POA_2$ 124 is configured as an inverting amplifier with amplifying factor of approximately 1.0.

It should also be noted that in those cases where each of the power operational amplifiers 120 and 124 are to be shut down, an external standby control signal is generated, for example, by the controller 302 in the form of a shutdown signal SD. In this way, both operational amplifiers can be selectively turned off as desired. In shutdown mode, the power consumption of the circuit 300 is virtually zero. This is possible since no circuits are required to be active in this mode and because the start-up time of the circuit 300 is very short compared with the warm-up time of the VFD filament 108. Another variation (not shown) of the circuit shown in FIG.4 includes adding an electronic switch in series with resistor $R_2$. The electronic switch can be controlled by the same shutdown signal SD in order to reduce the current consumption of the $R_2$ and $R_1$ resistor divider when the system is not in use.

It should also be noted that in a preferred embodiment, the shutdown feature can be implemented by using a low current control line instead of disconnecting directly the high current of the filament. This particular shutdown feature can be implemented by controlling low currents in the bias circuitry of the output power amplifiers (or switching elements) located inside the power operational amplifiers (not shown). It should be noted that this is a preferable shutdown protocol as opposed to switching (i.e., cutting) off the relatively higher current of the filament itself or turning off the DC power supply 101. By using the low current control line protocol, the shutdown of the VFD filament 108 can be accomplished using, for example, a mono-polar switch instead of a bipolar switch which is usually required with conventionally arranged VFD driver circuit circuits to shut-off the AC current in the VFD filament 108.

Figure 5:
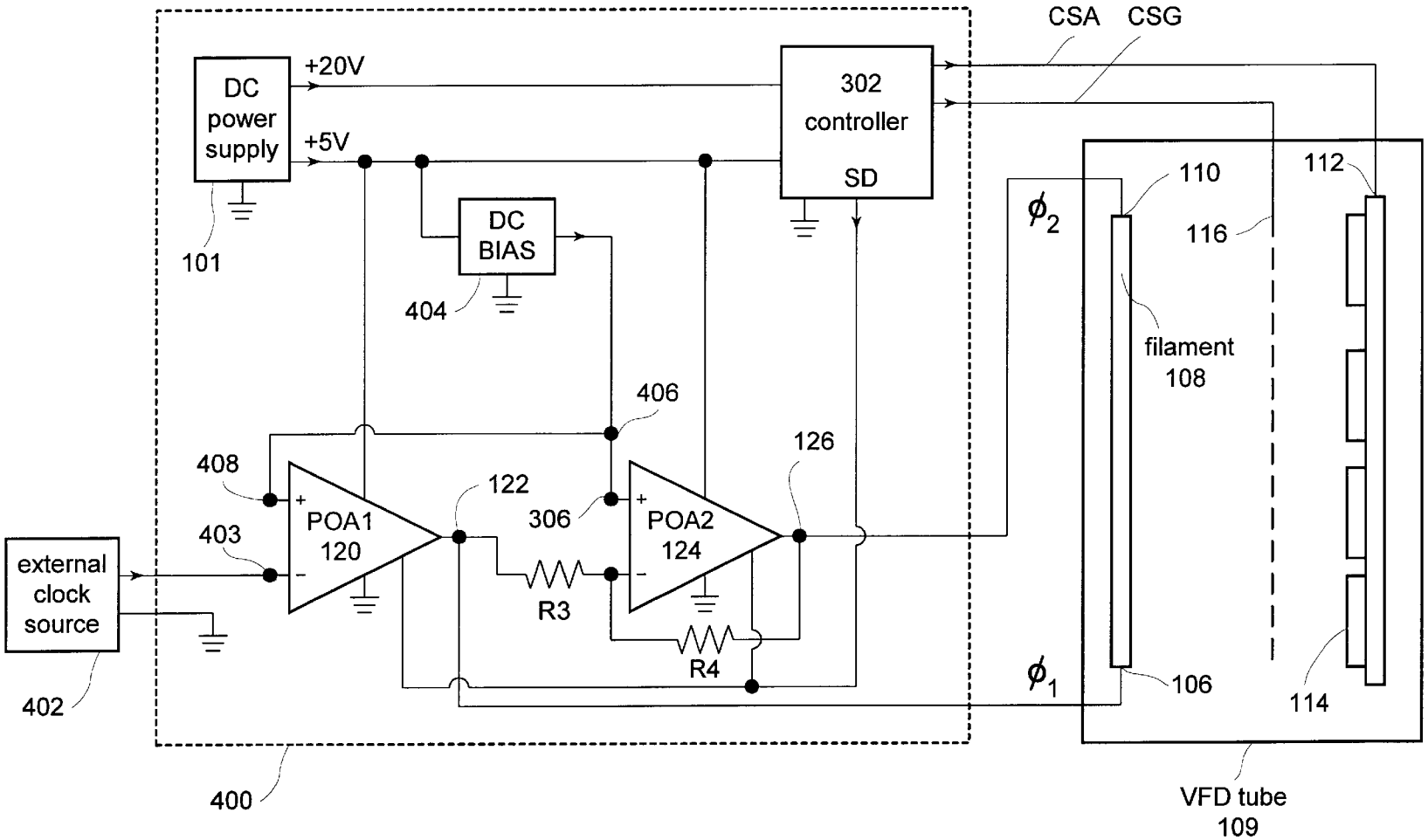
FIG. 5 illustrates a VFD filament driver circuit having an external clock source to drive the first Power Operational Amplifier (POA1) stage in accordance with an embodiment of the invention.

FIG. 5 illustrates a VFD filament driver circuit 400 having an external clock source 402 used to drive the $POA_1$ 120 in accordance with an embodiment of the invention. It should be noted that the driver circuit 400 is one particular embodiment of the driver circuit 300 described above and therefore should not be considered to limiting either the scope or intent of the invention. Accordingly, the external clock source 402 is connected to a negative input 403 of the $POA_1$ 120. In this way, the frequencies $f_1$ and $f_2$ of the output voltages $Ø_1$, $Ø_2$ can be set based upon a clock frequency CLK of the clock source 402. In this particular embodiment, the voltage divider 304 is replaced by a reference DC bias block 404 having an output node 406 coupled to the positive input node 306 of the $POA_2$ 124. In order to bias the POA1 120, the output node 406 is connected to a positive input node 408 of the $POA_1$ 120. It should be noted as well that since the clock source 402 is an external clock source, it can in fact be located remotely from the circuit 400. Such situations occur when, for example, the circuit 400 is included in a particular printed circuit board (PCB) whereas the clock source 402 is located in another location separate from but electrically coupled to the PCB board.

Figure 6:
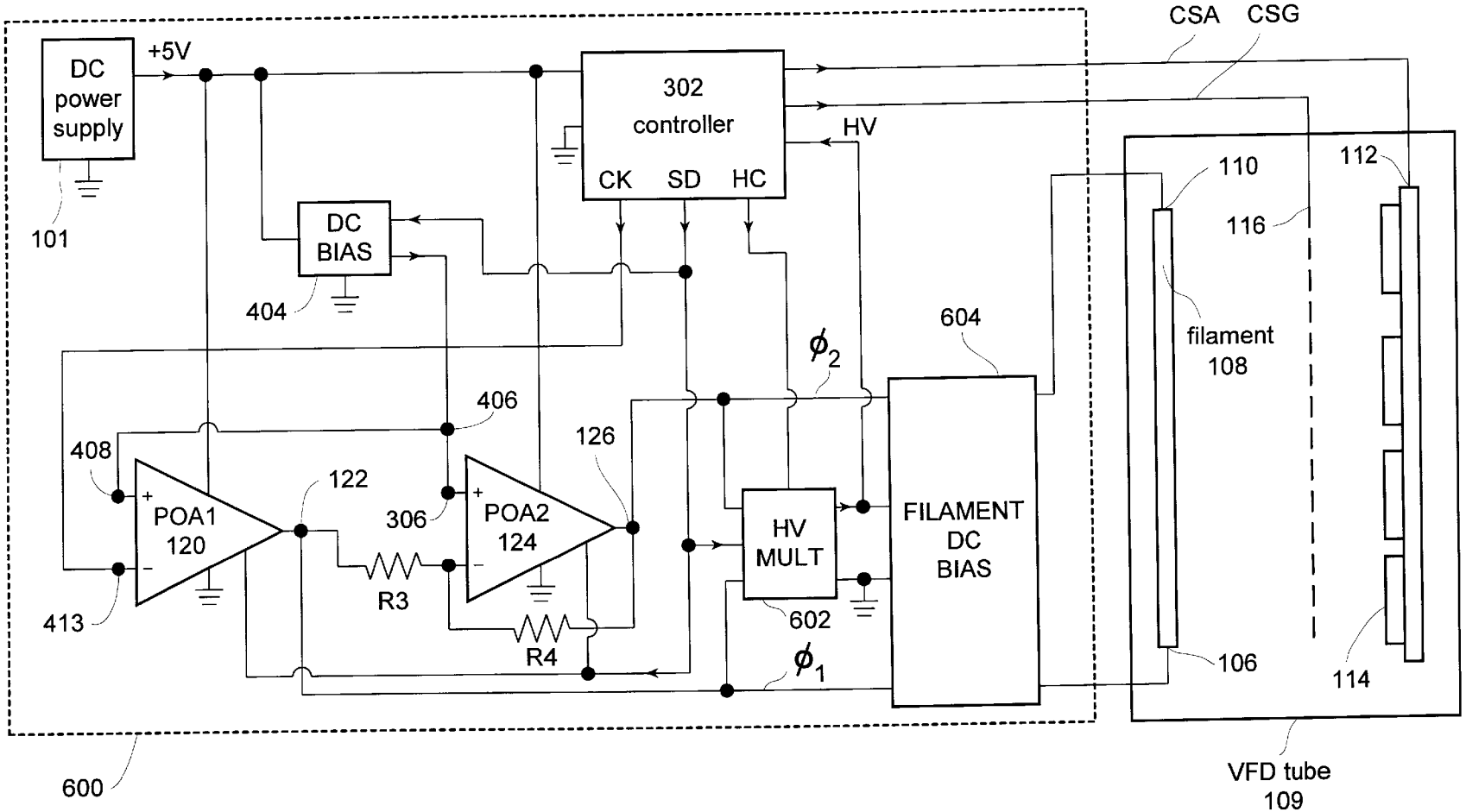
FIG. 6 shows a typical implementation of the invention where the clock is generated by a controller and having a VFD driver circuit in accordance with an embodiment of the invention.

FIG. 6 illustrates a VFD driver circuit 600 in accordance with yet another embodiment of the invention. It should be noted that the driver circuit 600 is one particular embodiment of the driver circuit 400 described above and therefore should not be considered to limiting either the scope or intent of the invention. Accordingly, in the VFD driver circuit 600 the clock source has been replaced by a clock signal CK generated by the controller 302 thereby obviating the need for a feedback circuit. In addition, high voltage DC power (such as 20V) is provided by a local high voltage (HV) multiplier 602 which can be either positive or negative with respect to ground depending on the particular controller used and the particular biasing scheme of the VFD tube 109. It should be noted that the HV multiplier can be replaced by any other circuits that can convert the input AC signal, which is also applied on the filament, into a higher DC voltage. The high voltage DC power is applied to the controller 302, which is using it to generate the CSA and CSG signals. A HV multiplier control signal HC provided by the controller 302 can be used to control the HV multiplier in any number of ways such as to turn on and/or turn off the HV multiplier without turning the VFD filament 108 on or off. This provides the capability of so called "instant start-up" of the VFD tube 109. The control signal HC can also be used to change (i.e., adjust) the voltage supplied by the HV multiplier 602 so as to either control the intensity of the light emitted by the VFD tube 109 (based upon user intervention) or control the intensity of the light emitted by the VFD tube 109 based upon ambient light changes (using an ambient light sensor). Another use for the control signal includes stabilizing the voltage supplied to and/or light intensity emitted by the VFD tube 109 in order to, for example, compensate in the voltage change caused by a varying number of icons activated and the resulting change in current supplied by the HV multiplier 602, which typically has a high output resistance. In the described embodiment, the HV multiplier 602 is configured to provide +20V. Connecting the VFD filament terminals 110 and 106 to the HV multiplier 602 is a filament DC bias block 604 that allows the VFD filament 108 to be biased in such a way as to allow control of a grid cut-off voltage.

The resistors shown in the proposed circuit can be easily integrated in a single chip solution. This is possible because the circuit is not sensitive to the absolute value of the resistors, but rather to their ratio. It is known that integrated resistors have much better ratio accuracy than absolute value. As will be appreciated to those skilled in the art, there are many types of resistor technologies (also referred to herein as resistor "types") that can be provided on an integrated circuit. For example, in the book Analysis and Design of Analog Integrated Circuits, 2nd edition, P. Grey et al., John Wiley & Sons, © 1977, 1978, a number of resistor technologies are described including, for example, base-diffused, emitter-diffused, pinched, epitaxial, pinched epitaxial, and thin film resistors. It is not important to the present invention which resistor technology is chosen as long as they have good matching.

The circuit and method of the present invention can, and typically do, form a part of a larger system and/or process. For example, the circuit of the present invention typically forms a part of a larger circuit that is integrated on a "chip" and packaged. The packaged integrated circuit is then made a part of a larger system by attaching it to a printed circuit (PC) board along with other electronic devices, connecting the resultant circuit to power supplies and to other devices and systems. It should therefore be understood for the product that results from the processes of the present invention include the circuit itself, integrated circuit chips including one or more circuits, larger systems (e.g. PC board level systems), products which include such larger systems, etc.

It should be noted that the inventive circuit requires only one power supply of approximately +5V for both controller logic and the VFD's filament driver circuit. The filament driver circuit can be used with most VFD tubes since the majority of these tubes have a filament voltage of less than 5V. This makes possible to add it in existent designs with only minor changes. The principle of the circuit and its simplicity offers the possibility to integrate the filament driver circuit 100 on the same integrated circuit with the grid/anode controller (also called microcontroller, computer or control logic). This is possible because the circuit is supplied with the same standard voltage as the controller, +5V.

The circuit can also be used to increase the lifetime of a VFD tube 109 by controlling the temperature of the VFD filament 108 by controlling the average electrical power applied to the VFD filament 108. The average electrical power can be changed by varying the amplitude, or the shape of the signal, for example by clipping off the sine wave, modifying the slope of a trapezoidal wave, etc. The inventive driver circuit 100 also provides for increased reliability because of: a) less components, b) no magnetic components like transformers or inductors, c)

What is claimed is:

1. An apparatus for supplying power to a vacuum fluorescent display (VFD) filament in a vacuum fluorescent display (VFD) unit having a display anode, comprising:

a DC power supply unit;

a first non-inverting self-oscillating stage coupled to the DC power supply having a self-oscillating stage output node connected to a first terminal of the VFD filament; and a second inverter stage coupled to the DC power supply having an inverter stage input node coupled to the self-oscillating non-inverter stage output node and an inverter stage output node connected to a second terminal of the VFD filament, wherein the self-oscillating stage provides a first output voltage waveform to the first terminal, and wherein the inverter stage provides a second output voltage waveform to the second terminal such that the first output voltage waveform and the second output voltage waveform are anti-phase such that the VFD filament provides a substantially uniform voltage differential profile in relation to the display anode.

2. An apparatus as recited in claim 1 further including a controller unit coupled to the display anode, the self-oscillating stage, and the inverter stage arranged to provide a control signal to the VFD unit.

3. An apparatus as recited in claim 1, wherein the self-oscillating stage comprises:

a self-oscillating first power operational amplifier.

4. An apparatus as recited in claim 3, wherein the self-oscillating stage further comprises:

a feedback circuit coupled to the self-oscillating first power operational amplifier arranged to control, a frequency of the first output voltage waveform and the second output voltage waveform, and a first shape of the first output voltage waveform and a second shape of the second output voltage waveform wherein the first output voltage waveform is in anti-phase relation to the second output voltage waveform.

5. An apparatus as recited in claim 4, wherein the first shape and the second shape are substantially the same.

6. An apparatus as recited in claim 1, wherein the inverting stage comprises:

a second power operational amplifier configured to have an amplifying factor of approximately 1.0.

7. An apparatus as recited in claim 6, further comprising:

a voltage divider or a voltage reference connecting the DC power supply to the second power operational amplifier.

8. An apparatus as recited in claim 7, wherein the voltage divider comprises:

a first resistor; and a second resistor connected in series to the first resistor.

9. An apparatus as recited in claim 5, where the first power operational amplifier and the second power operational amplifier each have a reduced output slew-rate in order to minimize electromagnetic interference (EMI).

10. An apparatus as recited in claim 4, where the first shape and the second shape each have reduced high frequency components in order to minimize the electromagnetic interference (EMI).

11. An apparatus as recited in claim 4, where the first shape and the second shape result in minimum heat dissipation in the driver circuitry.

12. An apparatus as recited in claim 4, where the first shape and the second shape optimize heat dissipation and EMI.

13. An apparatus as recited in claim 1, wherein the first stage includes a first electronic switch and wherein the inverter stage includes a second electronic switch.

14. An apparatus as recited in claim 4, wherein the first shape is selected from a group comprising: a square wave, a sinusoidal wave, a triangular wave, a trapezoidal wave, a clipped sinusoidal wave.

15. An apparatus as recited in claim 4, wherein the second shape is selected from the group comprising: a square wave, a sinusoidal wave, a triangular wave, a trapezoidal wave, a clipped sinusoidal wave.

16. A driver circuit for supplying power to a vacuum fluorescent display (VFD) filament in a vacuum fluorescent display (VFD) unit having a display anode, comprising:

a DC power supply unit;

a first power operational amplifier coupled to the DC power supply having a first power operational amplifier output node connected to a first terminal of the VFD filament;

a second power operational amplifier coupled to the DC power supply having a second power operational amplifier input node coupled to the first power operational amplifier output node and a second power operational amplifier output node connected to a second terminal of the VFD filament, wherein the first power operational amplifier provides a first output voltage waveform to the first terminal, and wherein the second power operational amplifier provides a second output voltage waveform to the second terminal such that the first output voltage waveform and the second output voltage waveform are in anti-phase relation such that the VFD filament provides a substantially uniform voltage differential profile in relation to the display anode; and an external clock source coupled to the first power operational amplifier arranged to control, a frequency of the first output waveform and the second output waveform, and a first shape of the first output waveform and a second shape of the second output waveform.

17. A driver circuit as recited in claim 16 further including a controller unit coupled to the display anode, the first power operational amplifier and the second power operational amplifier arranged to provide a control signal to the VFD unit.

18. A driver circuit as recited in claim 17 wherein the controller unit provides a shutdown signal to the first power operational amplifier and the second power operational amplifier.

19. A driver circuit as recited in claim 16, wherein the first shape and the second shape are substantially the same.

20. A driver circuit as recited in claim 16, wherein the second power operational amplifier is configured to have an amplifying factor of approximately 1.0.

21. A driver circuit as recited in claim 16, wherein the driver circuit is included in a printed circuit board (PCB), wherein the PCB is connected to the external clock source that is remote from the PCB.

22. A driver circuit as recited in claim 16, wherein the VFD filament is contained within a VFD tube, wherein the VFD tube is located in close proximity to driver circuit so as to substantially reduce EMI.

23. A method for supplying power to a vacuum fluorescent display (VFD) filament in a vacuum fluorescent display (VFD) unit having a display anode, a self-oscillating stage, an inverter stage and a DC power supply unit comprising:

coupling a non-inverting self-oscillating stage coupled to the DC power supply having a self-oscillating stage output node;

connecting the self-oscillating stage output node to a first terminal of the VFD filament;

coupling an inverter stage to the DC power supply having an inverter stage input node;

coupling the inverter stage input node to the self-oscillating stage output node; and coupling an inverter stage output node to a second terminal of the VFD filament, wherein the self-oscillating stage provides a first output voltage waveform to the first terminal, and wherein the inverter stage provides a second output voltage waveform to the second terminal such that the first output voltage waveform and the second output voltage waveform are anti-phase such that the VFD filament provides a substantially uniform voltage differential profile in relation to the display anode.

24. A method as recited in claim 23 further comprising coupling a controller unit to the display anode, the self-oscillating stage and the inverter stage arranged to provide a control signal and a shutdown signal.

25. A method as recited in claim 23, wherein the self-oscillating stage includes a first power operational amplifier and wherein the inverter stage includes a second power operational amplifier.

26. A method as recited in claim 25, further comprising:

coupling a feedback circuit to the first power operational amplifier arranged to control, a frequency of the first output voltage waveform and the second output voltage waveform, and a first shape of the first output voltage waveform and a second shape of the second output voltage waveform.

27. A method as recited in claim 25 comprising connecting the DC power supply to the second power operational amplifier by way of a voltage divider that includes, a first resistor connected in series with a second resistor.

28. A method as recited in claim 25, further comprising:

coupling a clock source to the first power operational amplifier arranged to control, a frequency of the first output voltage waveform and the second output voltage waveform, and a first shape of the first output voltage waveform and a second shape of the second output voltage waveform.

* * * * *

UNITED STATES PATENT AND TRADEMARK OFFICE

CERTIFICATE OF CORRECTION

PATENT NO. : 6,531,825 B1
DATED : March 11, 2003
INVENTOR(S) : Iacob

It is certified that error appears in the above-identified patent and that said Letters Patent is hereby corrected as shown below:

Column 7,
Line 62, after "inductors, c)" insert the following:
-- reduced number of wires (connections) from the system to the front panel board, d) simplified system power supply.

An additional advantage of the inventive VFD filament driver circuit 100 is that it can be located in close proximity to the VFD tube 109 since the filament driver circuit is simple, compact and requires a relatively few components, none of which are transformers or inductors. In addition, by reducing the number of wires between the front panel board and the system board (which is the source of the information to be displayed on the VFD) further EMI reduction can be realized. Also, there is no more need to connect two AC wires as is required with conventional VFD filament driver circuits since AC is generated locally from the DC. The DC is already present since it is required to supply the controller. In this way, the cost for materials and assembly is reduced since fewer wires are required. In some embodiments, a voltage multiplier circuit can be added in order to generate higher DC voltages required for the VFD. If this voltage multiplier circuit is added, the number of wire connections between the front panel board and the system board can be reduced by one wire again resulting in lower overall construction costs.

While this invention has been described in terms of several preferred embodiments, it is contemplated that alternatives, modifications, permutations and equivalents thereof will become apparent to those skilled in the art upon a reading of the specification and study of the drawings. It is therefore intended that the following appended claims include all such alternatives, modifications, permutations and equivalents as fall within the true spirit and scope of the present invention. --

Signed and Sealed this

Third Day of February, 2004

Jon W. Dudas

JON W. DUDAS
*Acting Director of the United States Patent and Trademark Office*